US010405596B2

(12) United States Patent
Burns

(10) Patent No.: US 10,405,596 B2
(45) Date of Patent: Sep. 10, 2019

(54) GRADUATION CAP

(71) Applicant: Flair 37, LLC, Tiffin, OH (US)

(72) Inventor: Jennifer Burns, Tiffin, OH (US)

(73) Assignee: FLAIR 37, LLC, Tiffin, OH (US)

( * ) Notice: Subject to any disclaimer, the term of this patent is extended or adjusted under 35 U.S.C. 154(b) by 755 days.

(21) Appl. No.: 14/976,347

(22) Filed: Dec. 21, 2015

(65) Prior Publication Data

US 2016/0174646 A1 Jun. 23, 2016

Related U.S. Application Data

(60) Provisional application No. 62/095,099, filed on Dec. 22, 2014.

(51) Int. Cl.

| | |
|---|---|
| ***A42B 1/02*** | (2006.01) |
| ***A42B 1/00*** | (2006.01) |
| ***A42B 1/24*** | (2006.01) |

(52) U.S. Cl.

CPC ..... *A42B 1/004* (2013.01); *A42B 1/02* (2013.01); *A42B 1/248* (2013.01)

(58) Field of Classification Search

CPC ..... A42B 1/004; A42B 1/02; A42B 1/238
See application file for complete search history.

(56) References Cited

U.S. PATENT DOCUMENTS 1,974,377 A 9/1934 Knutson
2,629,874 A * 2/1953 La Maida ..... A42B 1/02 2/171.01
2,987,731 A * 6/1961 Mills ..... A42B 1/02 2/171.01
3,134,107 A * 5/1964 Kelly ..... A42B 1/02 2/171.01
3,678,608 A * 7/1972 Minasy ..... E05B 73/0017 40/662
3,705,466 A * 12/1972 Sela ..... A42B 1/245 446/27
3,849,839 A * 11/1974 Zimber ..... A44B 1/32 24/108
4,068,322 A 1/1978 Rathel
4,344,240 A * 8/1982 Schiller ..... G09F 3/04 24/108
4,837,960 A * 6/1989 Skaja ..... A43B 23/00 36/136

(Continued)

OTHER PUBLICATIONS tasseltoppers.com, website: https://www.tasseltoppers.com.

(Continued)

*Primary Examiner* — Richale L Quinn

(74) *Attorney, Agent, or Firm* — Jacob M. Ward; Ward Law Office LLC

(57) ABSTRACT

A graduation cap system includes a board member, a fabric cover, and a skull cap. The board member has a major surface with at least one receiver body. The receiver body is configured to removably affix an at least one decoration body to the board member. The receiver body is disposed in at least one recess formed in the major surface of the board member, and secured to the board member. The fabric cover is disposed on both the major surface of the board member and the receiver body. The skull cap is disposed on an underside of the board member opposite the major surface, and is configured to be worn on a head of a user.

20 Claims, 5 Drawing Sheets

(56) References Cited

U.S. PATENT DOCUMENTS 4,847,917 A * 7/1989 Strongwater ..... A41D 19/0024 2/160
4,975,986 A 12/1990 Strongwater
5,136,726 A * 8/1992 Kellin ..... A41D 27/08 2/115
5,496,612 A * 3/1996 Ransbottom ..... A43B 3/0078 2/245
5,673,501 A * 10/1997 Mathews ..... A43B 3/0078 36/112
5,746,500 A * 5/1998 Chien ..... A43B 1/0036 36/137
D404,337 S * 1/1999 Goodman ..... D11/86
6,012,203 A * 1/2000 Baron Pearson ..... A41D 27/08 24/108
6,519,779 B1 * 2/2003 Taguchi ..... A42B 1/248 2/195.1
6,718,559 B1 * 4/2004 Davidson ..... A42B 3/0406 2/209.13
D554,847 S * 11/2007 Schmelzer ..... D2/946
7,350,274 B2 * 4/2008 Rogers ..... A42B 1/24 24/113 MP
7,350,275 B2 4/2008 Keller et al.
8,069,538 B2 * 12/2011 Wilcox ..... A43B 3/0078 119/858
8,869,312 B2 * 10/2014 Tuohy ..... A42B 1/004 2/209.13
9,241,526 B2 * 1/2016 Goldberg ..... A42B 1/248
2002/0020087 A1 * 2/2002 Griffith ..... G09F 1/10 40/124.4
2006/0010658 A1 1/2006 Bigley et al.
2007/0033705 A1 * 2/2007 Dickson ..... A42B 1/02 2/175.6
2013/0025028 A1 1/2013 Goldberg
2014/0366246 A1 12/2014 Nichols
2015/0114419 A1 4/2015 Miller
2015/0157093 A1 6/2015 Fowler

OTHER PUBLICATIONS

Trading Charms, website: www.lolatradingcharms.com.
Website: http://www.noosa-amsterdam.com.
Helmet Stickers, websitte: http://espn.go.com/video/clip?id=5854843 (Video reference of college helmet stickers).
Website address: https://www.etsy.com/listing/205820001/snap-button-display-stand-fits-18-or-20?ref=sc_2&plkey=4f812577bed57a6a059a98b606ca36ff6fd7e3b1%3A205820001&ga_search_query=snap+display&ga_search_type=all&ga_view_type=gallery.

* cited by examiner

GRADUATION CAP

CROSS-REFERENCE TO RELATED APPLICATIONS

This application claims the benefit of U.S. Provisional Application No. 62/095,099 filed on Dec. 22, 2014. The entire disclosure of the above application is hereby incorporated herein by reference.

FIELD

The disclosure generally relates to caps to be worn for academic ceremonies such as graduations.

BACKGROUND

The square academic cap, or mortarboard, is an item of academic dress that includes a horizontal square board fixed upon a skull-cap, typically with a tassel attached to the center. It is commonly referred to informally, in conjunction with an academic gown worn by a graduate, as a graduation cap and gown. The graduation cap, together with the gown, and sometimes a hood, are a customary uniform of a graduate at various levels of academia, including for pre-elementary, elementary, primary, high school and university graduations.

The overall structure of the graduation cap has remained unmodified for generations. In various societies around the world, it is tradition to decorate an individual's cap prior to the ceremony, creating a unique personalized attire. However, the common graduation cap does not easily permit awards or other embellishments to be displayed or attached on the board, without modifying or damaging the original accessory.

There is a continuing need for a graduation cap having interchangeable decorations or embellishments. Desirably, the graduation cap permits an individual to showcase achievements and successes at a graduation ceremony, and can also be displayed at later celebrations with the same decorations or embellishments.

SUMMARY

In concordance with the instant disclosure, a graduation cap having interchangeable decorations or embellishments, and which permits an individual to showcase achievements and successes at a graduation ceremony, and which can also be displayed at later celebrations with the same decorations or embellishments, has surprisingly been discovered.

In one embodiment, a graduation cap system includes a board member, a fabric cover, and a skull cap. The board member has a major surface with at least one receiver body. The receiver body is configured to removably affix an at least one decoration body to the board member. The receiver body is disposed in at least one recess formed in the major surface of the board member, and is secured to the board member. The fabric cover is disposed on both the major surface of the board member and the receiver body. The skull cap is disposed on an underside of the board member opposite the major surface, and configured to be worn on a head of a user.

In another embodiment, a kit includes the graduation cap system and a plurality of decoration bodies. Each of the decoration bodies may have a different indicia formed thereon, which may be symbolic of a particular award or achievement.

In a further embodiment, a method for decorating a graduation cap includes providing the graduation cap system and a plurality of decoration bodies. One of the decoration bodies is selected, and then affixed to the board member by causing the selected one of the decoration bodies to cooperate with the receiver body. The fabric cover is sandwiched between the selected one of the decoration bodies and the receiver body when the selected one of the decoration bodies is affixed to the receiver body.

In particular embodiments, the graduation cap involves snap "awards" having a female portion embedded in a board of the graduation cap, and a male portion that has a covering with an indicia such as an emblem or symbol indicating the award. The male portion also has an underlying nubbin that snaps into a hole formed in the female portion. The outer surface of the female portion's main body is also flush with the outer surface of the board, and is covered entirely by a flexible and thin fabric. A multitude of the female portions may be arranged in a grid or other configuration on the board of the cap, as desired.

The flexible and thin fabric allows the male portion to snap with the female portion without tearing the fabric. A four-way stretch knit fabric has been found to work well in this regard. There are no holes in the fabric through which the male portion is disposed, and the graduation cap system looks just like a normal graduation cap until the male portions of the snap awards are added. The fabric is simply sandwiched between the male and female portions when they are snapped together. The fabric also does not tear when the male portions are removed or replaced.

The male portion of the snap awards may also be modified by adding a plate-shaped core of cardboard or other filler material between the main body and the plate having the nubbin. This causes the nubbin of the male portion to extend outwardly from the main body of the snap award further than it otherwise normally would extend. The outwardly location of the nubbin of the male portion in this manner facilitates a cooperation of the snap awards with the recessed female portion in the outer surface of the board with the fabric sandwiched therebetween.

It should be appreciated that, often, recognition pins are applied to the lapel of the gown. However, such pins are expensive, limited and often go unnoticed. Advantageously, the graduation cap of the present disclosure may be used as part of a reward system for students achieving accomplishments during their academic careers. The cap will showcase one's earnings, memories, rewards and recognitions. The graduation cap with built-in receptacles provides a new platform for a student to showcase their achievements, rewards and memories without changing the traditional graduation attire or look associated with graduation ceremonies.

Furthermore, the graduation cap system of the present disclosure does not look different than a traditional cap until the awards or embellishments are added. The present disclosure instead involves a change of structure within the graduation cap, hidden from view by the overlying fabric. The changes to the internal board of the cap allow it to incorporate structure for attachment of the awards or embellishments. While the attachment is envisioned to be removable, in order to allow one to try different arrangements and types of the awards or embellishments, the attachment may also be made permanent if desired.

In exemplary embodiments, a stretchable and forgiving fabric covers the receptacles, e.g., metal, plastic or hole, to disguise the cap. The cap then can accept accessories, e.g., snap-on buttons. The embellishment has two parts: a female adapter housed within the cap; and a male (separate item) that connects to the female adapter (or vice versa). The female adapter is housed within the top board, beneath the fabric of the cap. These embellishments are referred to as snap buttons. The fabric cloth stretched over the board and receptors will allow for the embellishment to accept the snap attachment. In other words, the cloth will be between the female and male parts of the snap.

In operation, these awards or decorations may be given out throughout the year (daily or as often as needed) and be an affordable way for the student to be recognized. The graduation cap system of the present disclosure thereby may be used to motivate students, while rewarding positive behavior, and also providing the students a place to showcase those achievements.

In particular, the graduation cap system of the present disclosure has a dual purpose of empowering the individual student, and creating a greater strength and bond within the academic institution by encouraging and recognizing individual successes through friendly competition. One's achievements and successes from their academic career may be displayed and showcased on the cap. This would also personalize the cap, helping to identify the student during the ceremony from a distance.

Objects of the graduation cap system are not only to showcase and recognize individuals, but to also increase school spirit and respect within a school community. As nonlimiting examples, many different embellishments may be provided including, but are not limited to: academic success; athletic accomplishment; clubs/organizations involvement; personal achievements; respect; leadership; positive behavior; collegiate acceptance; and photographed memories. Other suitable types of embellishments may also be selected by a skilled artisan within the scope of the present disclosure.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
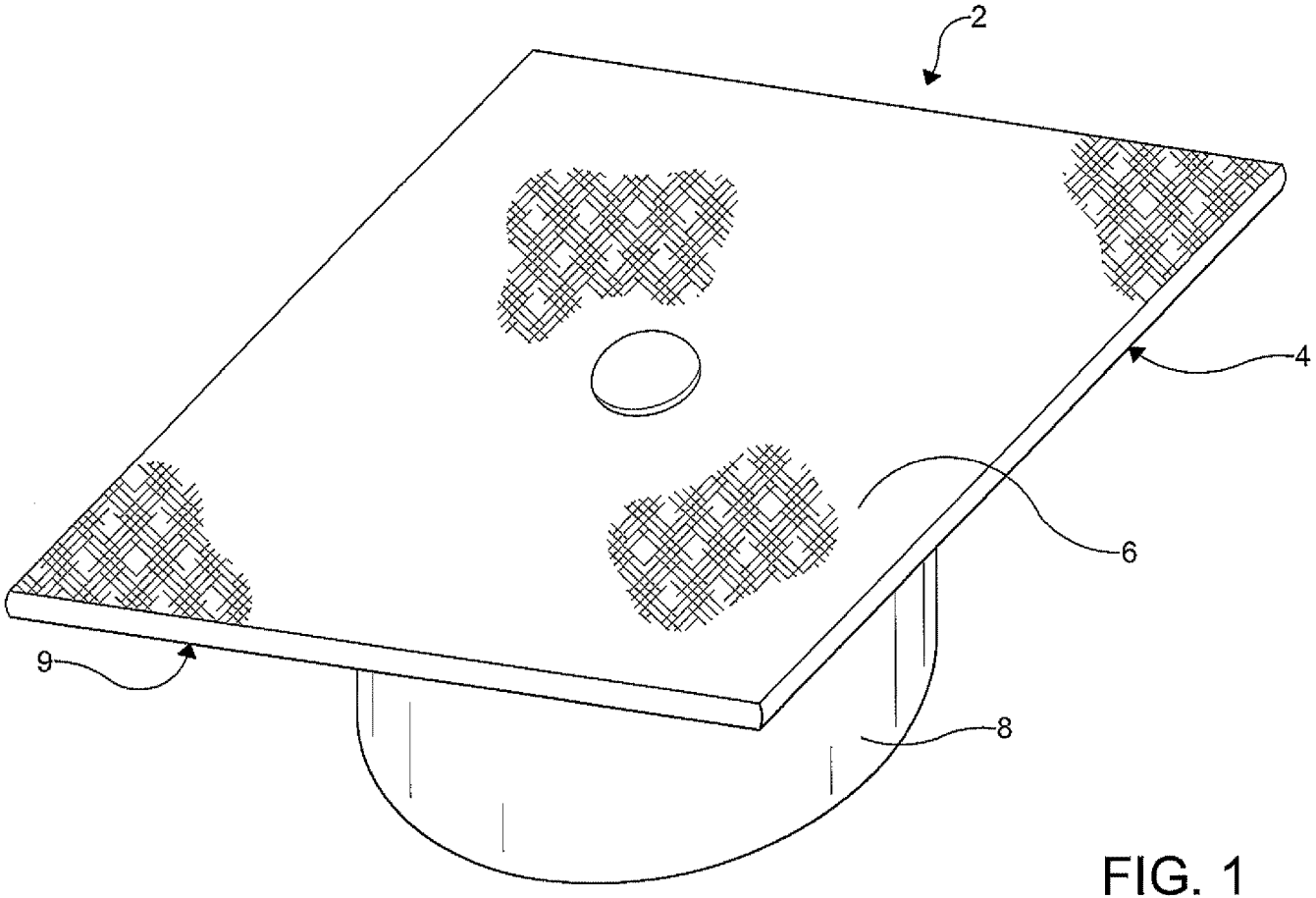
FIG. 1 is a perspective view of a graduation cap system according to one embodiment of the present disclosure, shown without decorations or awards.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical unless otherwise disclosed.

FIGS. 1-5 illustrate a graduation cap system 2 according to one embodiment of the present disclosure. The graduation cap system 2 includes a board member 4, a fabric cover 6, and a skull cap 8. The graduation cap system 2 is configured to be worn by a user during an academic ceremony such as a graduation, for example.

The board member 4 may be formed from cardboard or any other suitable material. In particular examples, the board member 4 has a generally square shape, although other shapes may also be employed within the scope of the disclosure. The fabric cover 6 may be formed from a resilient and stretchable fabric. For example, the fabric cover 6 may be formed from a four-way stretch knit fabric. The skull cap 8 is disposed on an underside 9 of the board member 4, and is configured to be worn on a head of the user. The skull cap 8 may be formed from the same or different fabric as the fabric cover 6, and may be connected to the board member 4 by the fabric cover 6. The skull cap 8 may also have an elastic band sewn therein, as desired. For example, suitable fabric materials for the fabric cover 6 and the skull cap 8 may include cotton, polyester, elastane, and combinations thereof. One of ordinary skill in the art may select other suitable materials for the board member 4, the fabric cover 6, and the skull cap 8, as desired.

As shown in FIG. 2-5, the board member 4 has a major surface 10 with at least one receiver body 12. The major surface 10 is disposed opposite the underside 9 of the board member 4, and in use may be understood as being an upper or top surface of the graduation cap system 2. The receiver body 12 is configured to removably affix an at least one decoration body 14 to the board member 4. The receiver body 12 is secured to the board member 4. In particular, the receiver body 12 is disposed in at least one recess 16 that is formed in the major surface 10 of the board member 4.

It should be appreciated that the fabric cover 6 is disposed on both the major surface 10 of the board member 4, and on the receiver body 12. In particular, the fabric cover 6 is disposed over an entirety of the major surface 10 of the board member 4. To facilitate the concealment of the receiver body 12 beneath the fabric cover 6, the receiver body 12 may have an upper surface 17 that is substantially flush with the major surface 10 of the board member 4. For example, the upper surface 16 of the main body may be arranged substantially on a plane defined by the major surface 10 of the board member 4. In this manner, the receiver body 12 is fully concealed by the fabric cover 6, so that the covered board member 4 has the general appearance of a conventional mortarboard for an academic cap.

Figure 4:
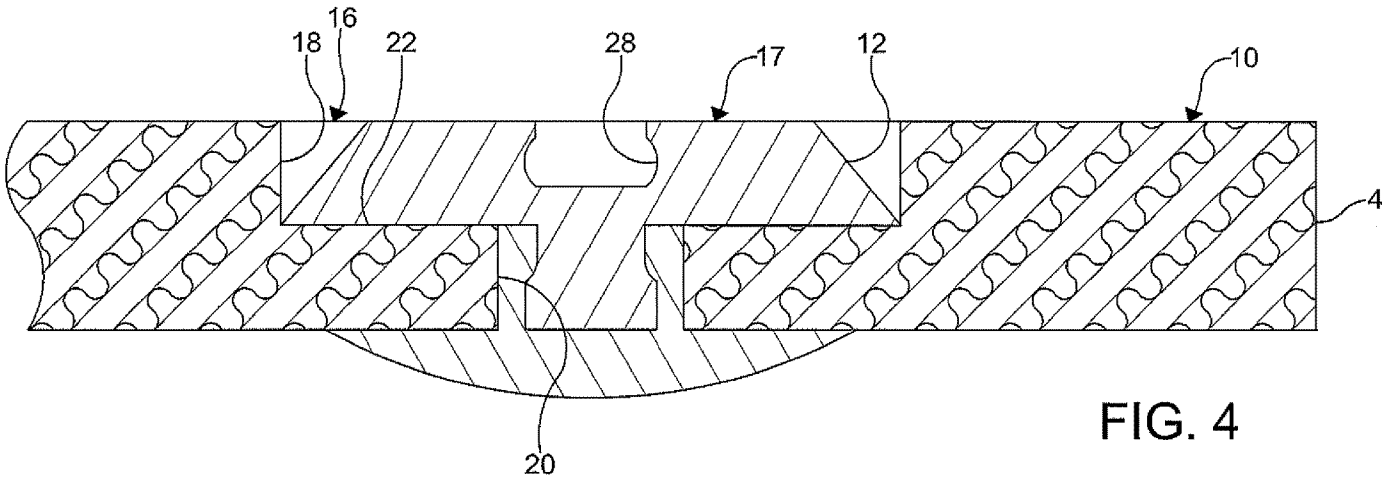
FIG. 4 is an enlarged fragmentary, cross-sectional side elevational view of the graduation cap system taken along section line 4-4 in FIG. 2, showing a receiving body without a fabric covering, and without a declaration or award.
Figure 5:
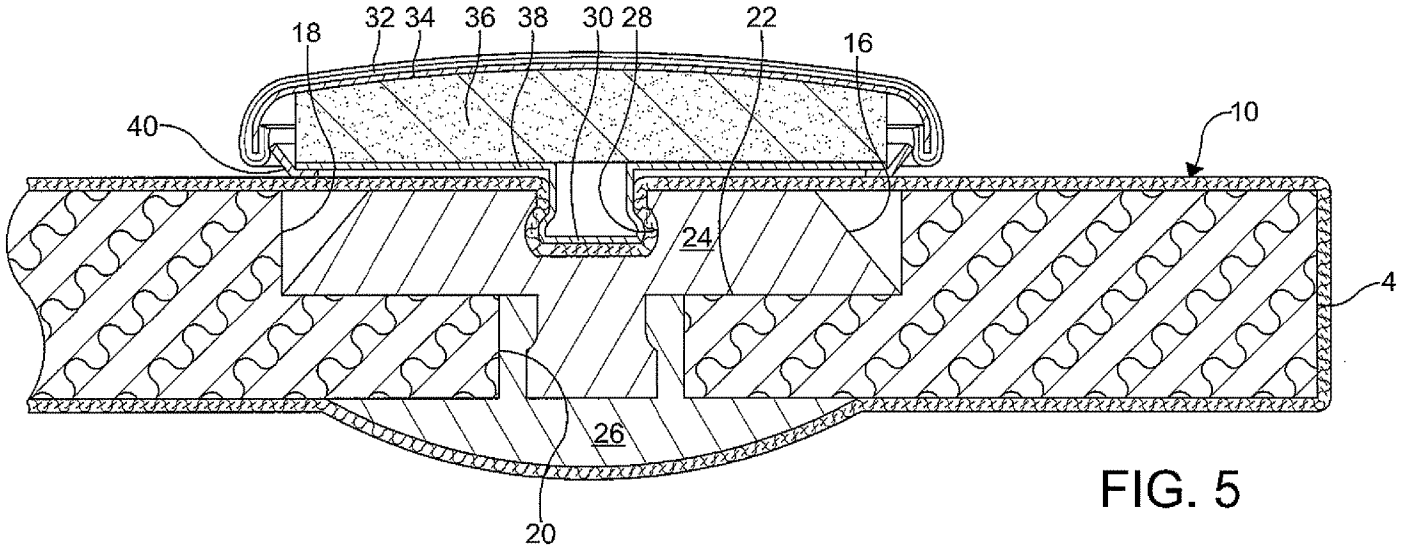
FIG. 5 is an enlarged fragmentary, cross-sectional side elevational view of the graduation cap system taken along section line 5-5 in FIG. 2, showing a receiving body with a fabric covering sandwiched between the receiving body and a declaration or award affixed to the receiving body.

In a particular embodiment, shown in FIGS. 4 and 5, the recess 16 is defined by a first opening 18 and a second opening 20, both of which are formed in the board member 4. The first opening 18 has a diameter larger than a diameter of the second opening 20. The first opening 18 and the second opening 20 are in communication with one another and together forming a hole through the board member 4.

For example, the first opening 18 extends inwardly from the major surface 10 of the board member 4, and only partly through the board member 4, to an inner surface 22 of the board member 4. The second opening 20 extends from the inner surface 22 of the board member 4, through the board member 4, to the underside 9 of the board member 4. The hole formed by the communication between the first opening 18 and the second opening 20 thereby provides a passage through an entirety of a thickness of the board member 4.

The receiver body 12 may be disposed through the hole in a manner that secures the receiver body 12 in the recess 16. For example, as illustrated in FIGS. 4 and 5, the receiver body 12 may have a first portion 24 and a second portion 26. The first portion 24 may rest on the inner surface 22 in the first opening 18, and may be connected through the second opening 20 to the second portion 26. Together, the first portion 24 and the second portion 26 sandwich the board member 4 to secure the receiver body 12 to the board member 4.

The decoration body 14 of the present disclosure may be removably connected with the receiver body 12. In certain examples, the decoration body 14 of the present disclosure is configured to snap-fit with the receiver body 12. For example, the receiver body 12 may have a female portion 28, and the decoration body 14 may have a corresponding male portion 30 (shown in FIGS. 6-8) that is configured to snap fit with the female portion 28. However, other suitable means for removably connecting the decoration body 14 with the receiver body 12 may also be employed by a skilled artisan, as desired.

Figure 6:
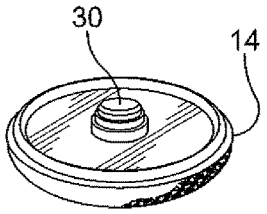
FIG. 6 is a perspective view of a decoration or award for use with the graduation system illustrated in FIGS. 1-5.
Figure 7:
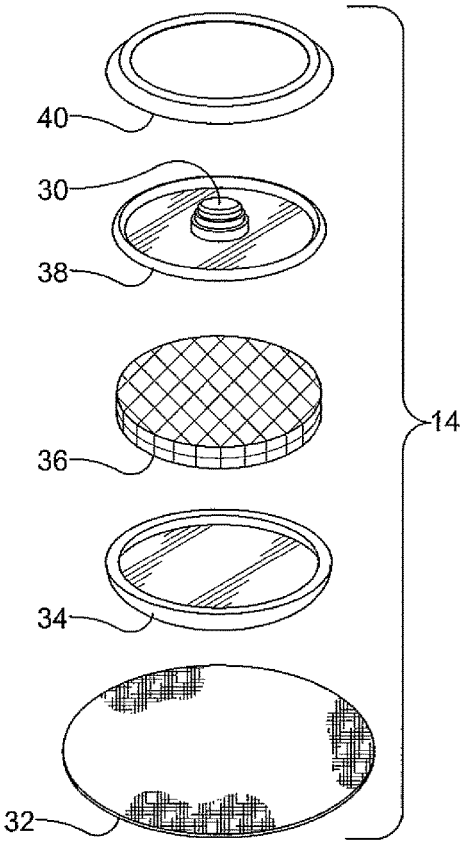
FIG. 7 is an exploded perspective view of the decoration or award illustrated in FIG. 6.
Figure 8:
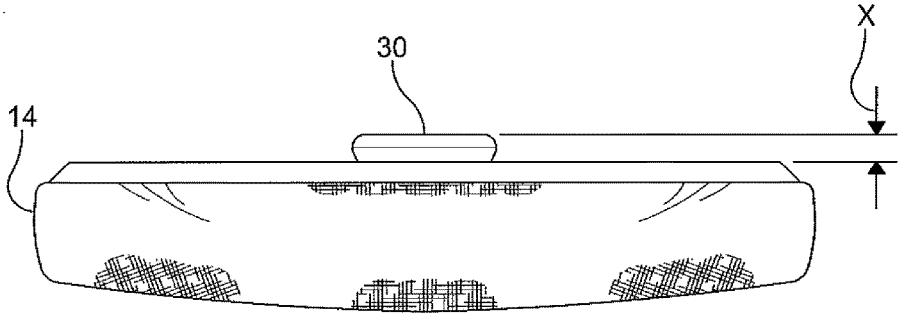
FIG. 8 is an enlarged side elevational view of the decoration or award illustrated in FIG. 6, showing a location of a nubbin relative to a reminder of a body of the decoration or award.

In a particular embodiment, shown in FIGS. 6-8, the decoration body 14 may include an embellishment layer 32, a shell 34, a filler board 36, a male snap 38, and a ring 40. It should also be understood that other layers, such as plastic cover layers and the like may be disposed in the decoration body 14, either on or between the other components, as desired.

The shell 34 has the embellishment layer 32 disposed thereon, for purposes of decorating the graduation cap system 2 where the decoration body 14 is coupled with the receiver body 12. The embellishment layer 32 may be a cloth material, for example, having a decorative color, pattern, or indicia 42. One of ordinary skill in the art may also use other suitable materials for the embellishment layer 32, such as plastic or elastomeric materials, within the scope of the present disclosure.

The filler board 36 is disposed inside of the shell 34. The filler board 36 may be formed from a paper, a polyurethane foam, or a polystyrene chipboard, for example, and is configured to support the male snap 38 on the shell 34 and against the overlying ring 40. In particular, the filler board 36 may abut both an inside of the shell 34 and the male snap 38, and thereby support the male snap 38 within the decoration body 14. Other suitable materials for the filler board 36 may also be employed, as desired.

In certain embodiments, the ring 40 may press-fit with the shell 34 to together hold the embellishment layer 32, the filler board 36, and the male snap 38 within the assembled decoration body 14. The ring 40 is disposed over the male snap 38 and secures the male snap 38 to the shell 34. For example, an edge of the embellishment layer 32 may be pinched between the ring 40 and the shell 34 to hold the embellishment layer 32 onto the shell 34. Other means including adhesives or mechanical fasteners for holding the embellishment layer 32 onto the shell 34 may also be employed, as desired.

The male snap 38 has the male portion 30, which may be in the form of a nubbin, as illustrated in FIGS. 6-8. Referring to FIG. 8, the male portion 30 of the male snap 38 extends outwardly from and has a free end spaced apart a distance X from a remainder of the decoration body 14. In a particular example, the distance X is approximately 0.125 inches in length. However, other appropriate lengths for the distance X may be selected by a skilled artisan, as desired. The arrangement of the male portion or nubbin 30 in this manner advantageously permits the decoration body 14 to be coupled with the concealed receiver body 12 through the fabric cover 6, for example, as shown in FIG. 5.

Figure 2:
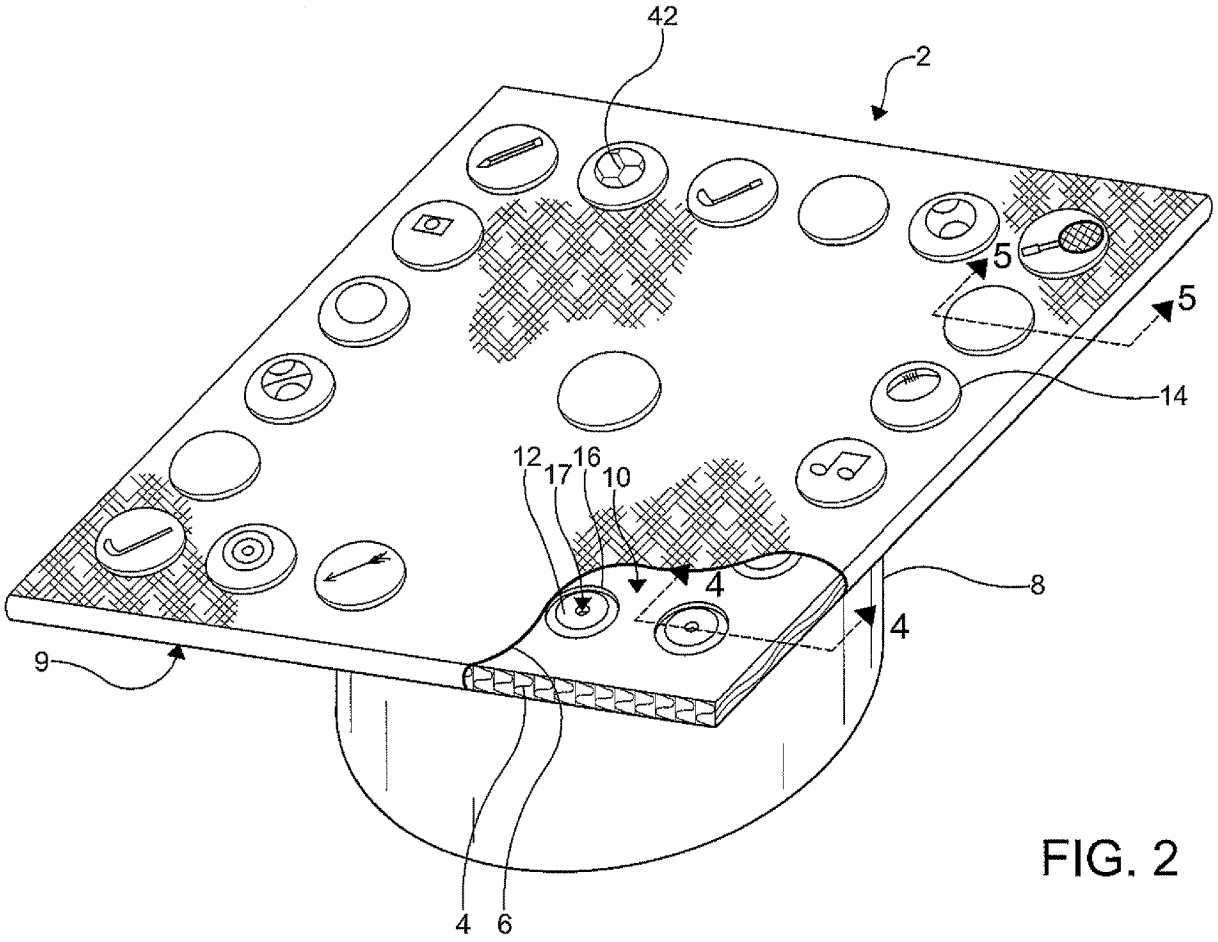
FIG. 2 is a perspective view of the graduation cap system illustrated in FIG. 1, shown with a plurality of decorations or awards, and a portion of a fabric covering removed to show the underlying board member with receiving bodies for affixing the decorations or awards to the board member.

In exemplary embodiments, as depicted in FIG. 2, the at least one receiver body 12 includes a plurality of receiver bodies 12, the at least one decoration body 14 includes a plurality of decoration bodies 14, and the at least one recess 16 includes a plurality of recesses 16. Each of the recesses 16 is configured to receive one of the receiver bodies 12, and each of the receiver bodies 12 is configured to receive one of the decoration bodies 14.

Figure 3:
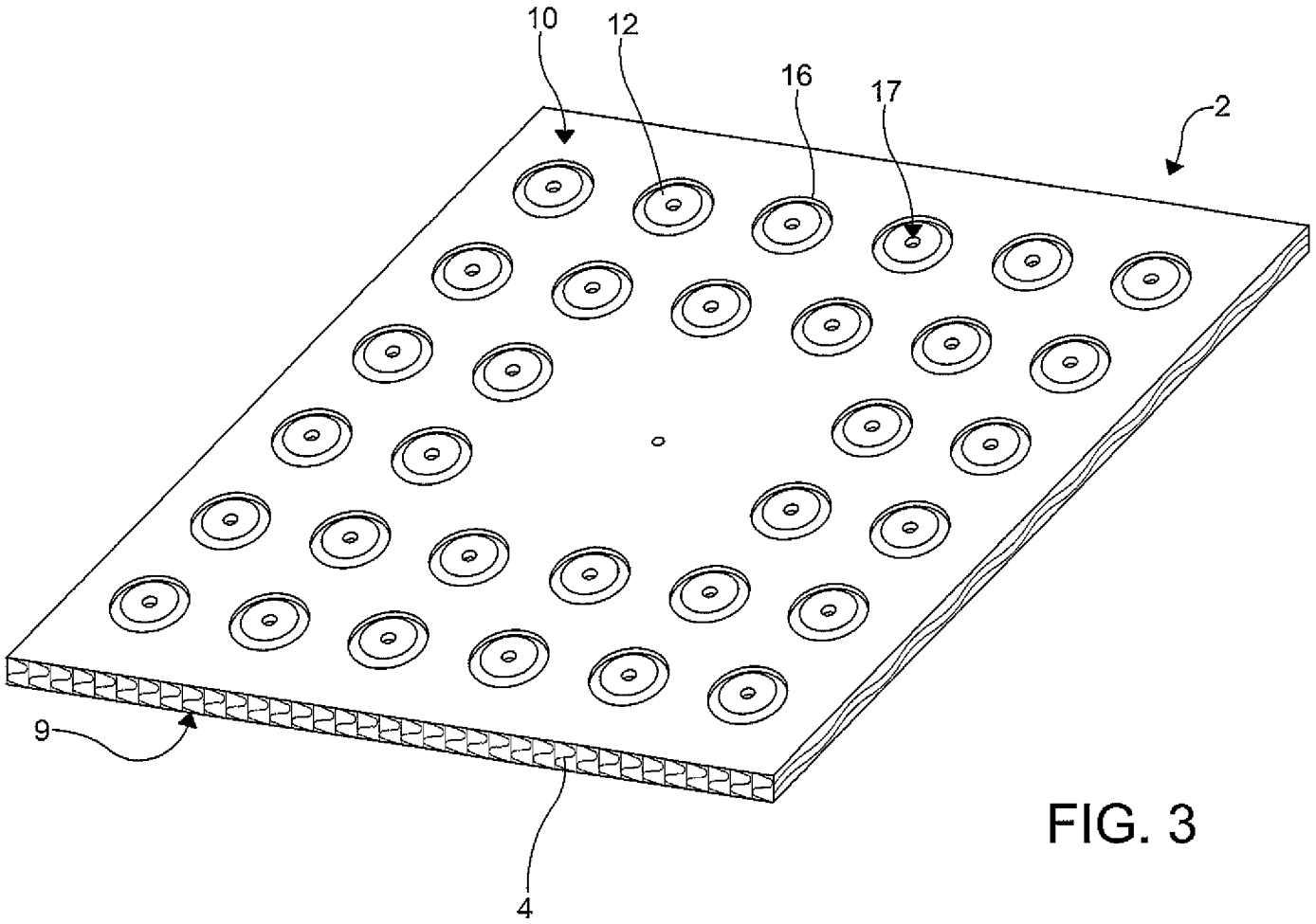
FIG. 3 is a perspective view of the board member for the graduation cap system illustrated in FIGS. 1-2, according to one embodiment of the disclosure.

The plurality of recesses 14 and the plurality of receiver bodies 12 may be arranged in an array or a grid across the major surface 10 of the board member 4, for example, as shown in FIG. 3. Other arrangements or configurations of the receiver bodies 12 on the major surface 10 may also be used within the scope of the disclosure.

It should be understood that the graduation system 2 of the present disclosure may be provided in form of a kit including the graduation cap system and the plurality of decoration bodies 14. The user may select different ones of the decoration bodies 14 to couple to the board member 4, and thereby customize the graduation cap system 2 for the individual user's preferences, as desired.

Advantageously, the graduation cap system 2 permits the use of many different interchangeable decoration bodies 14 or embellishments. This permits the individual user to showcase achievements and successes at a graduation ceremony. Furthermore, the graduation cap system 2 with the decoration bodies 14 can be saved and displayed at later celebrations.

While certain representative embodiments and details have been shown for purposes of illustrating the invention, it will be apparent to those skilled in the art that various changes may be made without departing from the scope of the disclosure, which is further described in the following appended claims.

What is claimed is:

1. A graduation cap system, comprising:

a board member having a major surface with at least one receiver body that is configured to removably affix an at least one decoration body to the board member, the receiver body disposed in at least one recess formed in the major surface of the board member and secured to the board member;

a fabric cover disposed on both the major surface of the board member and the receiver body; and a skull cap disposed on an underside of the board member opposite the major surface and configured to be worn on a head of a user, wherein the fabric cover has a thickness that permits it to be sandwiched between the receiver body and the decoration body where the decoration body is removably affixed by the receiver body to the board member.

2. The graduation cap system of claim 1, wherein the receiver body has an upper surface that is flush with the major surface of the board member.

3. A graduation cap system, comprising:

a board member having a major surface with at least one receiver body that is configured to removably affix an at least one decoration body to the board member, the receiver body disposed in at least one recess formed in the major surface of the board member and secured to the board member;

a fabric cover disposed on both the major surface of the board member and the receiver body; and a skull cap disposed on an underside of the board member opposite the major surface and configured to be worn on a head of a user, wherein the recess is defined by a first opening and a second opening formed in the board member, the first opening having a diameter larger than a diameter of the second opening, the first opening and the second opening in communication with one another and together forming a hole through the board member, the receiver body disposed through the hole.

4. The graduation cap system of claim 3, wherein the first opening extend inwardly from the major surface of the board member and only partly through the board member to an inner surface of the board member, and the second opening extends from the inner surface of the board member through the board member to the underside of the board member.

5. The graduation cap system of claim 1, wherein the decoration body is configured to snap-fit with the receiver body.

6. The graduation cap system of claim 5, wherein the decoration body has a male portion and the receiver body has a corresponding female portion, the male portion configured to snap-fit with the female portion.

7. A graduation cap system, comprising:

a board member having a major surface with at least one receiver body that is configured to removably affix an at least one decoration body to the board member, the receiver body disposed in at least one recess formed in the major surface of the board member and secured to the board member;

a fabric cover disposed on both the major surface of the board member and the receiver body; and a skull cap disposed on an underside of the board member opposite the major surface and configured to be worn on a head of a user, wherein the decoration body includes an embellishment layer, a shell having the embellishment layer disposed thereon, a filler board disposed inside the shell, a male snap with a nubbin disposed on the filler board, and a ring disposed over the male snap and that secures the male snap to the shell.

8. The graduation cap system of claim 7, wherein an edge of the embellishment layer is pinched between the ring and the shell to hold the embellishment layer on the shell.

9. The graduation cap system of claim 7, wherein the filler board abuts both the shell and the male snap and supports the male snap within the decoration body.

10. The graduation cap system of claim 7, wherein the nubbin of the male snap extends outwardly from and has a free end spaced apart from a remainder of the decoration body.

11. The graduation cap system of claim 1, wherein the at least one receiver body includes a plurality of receiver bodies, and the at least one recess includes a plurality of recesses, and each of the recesses is configured to receive one of the receiver bodies.

12. The graduation cap system of claim 11, wherein the plurality of recesses and the plurality of receiver bodies are arranged in an array across the major surface of the board member.

13. The graduation cap system of claim 1, wherein the decoration body has an indicia disposed thereon.

14. The graduation cap system of claim 1, wherein the fabric cover is formed of a material that does not permit any portion of receiver body or the decoration body to tear therethrough.

15. The graduation cap system of claim 1, wherein the fabric cover is a four way stretch knit fabric.

16. The graduation cap system of claim 1, wherein the fabric cover covers an entirety of the major surface of the board member.

17. The graduation cap system of claim 1, wherein the fabric cover attaches the skull cap to the board member.

18. A graduation cap kit, comprising:

a graduation cap system including a board member having a major surface with at least one receiver body, the receiver body disposed in at least one recess formed in the major surface of the board member and secured to the board member, a fabric cover disposed on both the major surface of the board member and the receiver body, and a skull cap disposed on an underside of the board member opposite the major surface and configured to be worn on a head of a user, wherein the fabric cover has a thickness that permits it to be sandwiched between the receiver body and the decoration body where the decoration body is removably affixed by the receiver body to the board member; and a plurality of decorations, the receiver body configured to removably affix one of the decorations to the board member.

19. A method for decorating a graduation cap, comprising:

providing a graduation cap system including a board member having a major surface with at least one receiver body, the receiver body disposed in at least one recess formed in the major surface of the board member and secured to the board member, a fabric cover disposed on both the major surface of the board member and the receiver body, and a skull cap disposed on an underside of the board member opposite the major surface and configured to be worn on a head of a user, wherein the fabric cover has a thickness that permits it to be sandwiched between the receiver body and the decoration body where the decoration body is removably affixed by the receiver body to the board member;

providing a plurality of decorations, the receiver body configured to removably affix the one of the decorations to the board member;

selecting the one of the decorations for affixing to the board member; and affixing the one of the decorations selected to the board member by causing the one of the decorations selected to cooperate with the receiver body, the fabric cover sandwiched between the one of the decorations selected and the receiver body.

20. A decoration body for a graduation cap system, the graduation cap system including a board member having a major surface with a receiver body that is configured to removably affix the decoration body to the board member, the receiver body disposed in at least one recess formed in the major surface of the board member and secured to the board member, a fabric cover disposed on both the major surface of the board member and the receiver body, and a skull cap disposed on an underside of the board member opposite the major surface and configured to be worn on a head of a user, the decoration body comprising:

an embellishment layer;

a shell having the embellishment layer disposed thereon;

a filler board disposed inside the shell;

a male snap with a nubbin disposed on the filler board; and a ring disposed over the male snap and that secures the male snap to the shell, wherein the male snap is configured to be received by the receiver body to removably affix the decoration body to the board member of the graduation cap system.

* * * * *